United States Patent [19]

Hoff et al.

[11] 4,113,442

[45] Sep. 12, 1978

[54] MIDDLE DISTILLATE FUEL COMPOSITIONS

[75] Inventors: Siebe Hoff; Gerhardus Ockers; Arnold A. Buitelaar; Eduard J. Van De Kraats, all of Amsterdam, Netherlands

[73] Assignee: Shell Oil Company, Houston, Tex.

[21] Appl. No.: 779,645

[22] Filed: Mar. 21, 1977

Related U.S. Application Data

[63] Continuation-in-part of Ser. No. 772,383, Feb. 28, 1977, abandoned, which is a continuation of Ser. No. 618,082, Sep. 30, 1975, abandoned.

[30] Foreign Application Priority Data

Mar. 17, 1976 [GB] United Kingdom ..... 10696/76

[51] Int. Cl.[2] ..... C10L 1/18

[52] U.S. Cl. ..... 44/66; 44/70

[58] Field of Search ..... 44/70, 66

[56] References Cited

U.S. PATENT DOCUMENTS

| | | | |
|---|---|---|---|
| 2,833,634 | 5/1958 | Hill | 44/70 |
| 3,068,083 | 12/1962 | Gee et al. | 44/70 |
| 3,277,152 | 10/1966 | Steinberg | 44/70 |
| 3,419,368 | 12/1968 | Leas | 44/70 |

*Primary Examiner*—Winston A. Douglas
*Assistant Examiner*—Y. Harris-Smith

[57] ABSTRACT

Middle distillate compositions are disclosed which contain a filterability improver which may be considered to be a mono- or polyester of a specified $C_{10-40}$ hydrocarbyl alcohol and a hydroxy-carboxylic acid and, in some cases, a pour point depressant.

19 Claims, No Drawings

MIDDLE DISTILLATE FUEL COMPOSITIONS

This is a continuation-in-part Ser. No. 772,383, filed Feb. 28, 1977, now abandoned, which is a continuation of Ser. No. 618,082, filed Sept. 30, 1975, now abandoned.

FIELD OF THE INVENTION

The invention relates to a middle distillate fuel composition comprising an additive which improves the filterability of the fuel at low temperatures.

PRIOR ART

Middle distillate fuels are fuels having a boiling point range in the range of from about 120° to 280° C at atmospheric pressure and a cloud point usually in the range of from −40° C to +8° C. Such fuels may be straight run products or catalytically or thermally cracked products or hydrotreated products or mixtures thereof and they find utility as heating, diesel or jet fuels.

A middle distillate fuel suffers from the problem that cooling thereof causes its paraffin wax content to crystallize out until eventually a solid mass of fuel and paraffin wax crystals is formed. The crystallization of these paraffin wax crystals is a serious problem when the fuels have to be pumped and filtered at low temperatures, since deposits of paraffin wax crystals in fuel lines and filters impede the transfer of the fuel to its site of combustion.

It is already known to add oil-soluble additives to middle distillate fuel in an attempt to improve the flowability and filterability thereof at low temperatures. Additives which improve the flowability of the fuel by lowering its pour-point are generally referred to as pourpoint depressants and those which improve the filterability of the fuel are generally referred to as filterability improvers or crystal nucleating agents. As a general rule, pour-point depressants have little or no effect on the filterability of the fuel and filterability improvers have little or no effect on the flowability of the fuel. In addition, most filterability improvers have little effect on the filterability of a fuel in the absence of pour-point depressants.

Combinations of additives which allegedly improve the flowability and filterability of fuels are disclosed in U.S. Pat. No. 3,275,427 (combination of an ethylene/vinylacetate copolymer and polylaurylacrylate); German Published Application No. 2,156,425 (combinations of various copolymers, e.g., ethylene/vinylacetate and additives such as sorbitantristearate) and Netherlands Published Application No. 7,201,824 (combinations of two different ethylene/vinylacetate copolymers).

We have now discovered a novel type of additive which improves the filterability of middle distillate fuels at low temperatures.

BRIEF DESCRIPTION OF THE INVENTION

According to the present invention, a middle distillate fuel composition comprises a major proportion of a middle distillate fuel and a minor proportion of a filterability improver which may be considered to be a hydrocarbyl ester of a hydroxy-carboxylic acid, which the proviso that the hydrocarbyl group includes at least one uninterrupted chain of at least 8 methylene groups, i.e. at least one $—CH_2)_n$ chain wherein n is 8 or higher and has a total of 10–40 and preferably 10–30 carbon atoms. In some fuels, the presence of a minor amount of a pour-point depresent is required for effective filterability improvement.

DETAILED DESCRIPTION OF THE INVENTION

The filterability improvers for use in the above compositions, may be mono- or polyesters with diesters being preferred, and may contain one or more hydroxyl groups, with those containing one hydroxyl group being preferred. The esters preferably contain a hydroxyl group on the $\alpha,\beta$, $\gamma$ or $\delta$ carbon atom relative to the carbonyl carbon atom of an ester group, with a hydroxyl group on the $\alpha$ or $\beta$ carbon atom being particularly preferred.

The filterability improvers may be prepared by various techniques, e.g. by reacting an appropriate alcohol with a hydroxy-carboxylic acid (direct esterification) or with a lactone or lactide (indirect esterification) or with, say, a $C_{1-6}$ alkyl hydroxy-carboxylic ester (transesterification). Thus it can be seen that although the filterability improvers need not be derived directly from a hydroxy-carboxylic acid they have a structure such that they may be considered to be esters of hydroxy-carboxylic acids. The following discussion is concerned with filterability improvers derived by direct esterification.

Suitable hydroxy-carboxylic acids, from which the filterability improvers may be prepared by direct esterification, include mono- and polycarboxylic acids, with dicarboxylic acids being preferred, and may contain one or more hydroxyl groups, with those containing one hydroxyl group being preferred. The acids preferably contain a hydroxyl group on the $\alpha$, $\beta$, $\gamma$ or $\delta$ carbon atom of the carboxylic group, with a hydroxyl group on the $\alpha$ or $\beta$ carbon atom being particularly preferred. The acids preferably contain from 2 to 10 carbon atoms.

The acids may be hydroxy-alkyl, -alkenyl, -alkynyl, -aralkyl or -alkaryl carboxylic acids, with hydroxy-alkyl carboxylic acids, i.e., hydroxyl substituted aliphatic carboxylic acids, being preferred. The acids may contain non-hydrocarbyl groups other than hydroxyl or carboxylic groups. The acids may be linear or branched.

Examples of suitable hydroxy-carboxylic acids are hydroxy acetic acid, 2-hydroxy propionic acid, 2-hydroxy-n-butyric acid, 2-hydroxy-n-valeric acid, 2-hydroxy-n-caproic acid, 2-hydroxy-3-butenoic acid, phenylhydroxyacetic acid, 2-hydroxy-3-phenyl-propionic acid, 3-hydroxy-propionic acid, 3-hydroxy-*n*-butyric acid, 3-hydroxy-*n*-valeric acid, 3-hydroxy-*n*-caproic acid, 4-hydroxy-butyric acid, 4-hydroxy-*n*-valeric acid, 4-hydroxy-*n*-caproic acid, 5-hydroxy-*n*-valeric acid, 5-hydroxy-*n*-caproic acid, 2-hydroxy-propanedioic acid (hydroxy malonic acid), 2-hydroxy-butanedioic acid (malic acid), 2-hydroxy-3-methyl-butanedioic acid (citramalic acid), 2-hydroxy-pentanedioic acid (2-hydroxy-glutaric acid), 3-hydroxy-3-carboxyl-pentanedioic acid (citric acid), dihydroxy-butanoic acids such as 2,3-dihydroxybutanoic acid, dihydroxy-pentanoic acids such as 2,3-dihydroxy-n-pentanoic acid, hexanoic acids such as 2,3-dihydroxy-n-hexanoic acid, 2,3-dihydroxy butanedioic acid (tartaric acid) and 2,3,4-trihydroxy pentanedioic acid. A particularly preferred acid is 2-hydroxy-butanedioic acid (malic acid).

Suitable $C_{10-40}$ hydrocarbyl alcohols (having at least one uninterrupted chain of at least 8 methylene groups, preferably at least 10 methylene groups and more preferably at least 12 methylene groups), from which the filterability improvers may be prepared by direct esterification, may be alkyl, alkenyl or aralkyl alcohols with alkyl alcohols being preferred. The $C_{10-40}$ hydrocarbyl alcohols preferably contain from 15-25 carbon atoms. The $C_{10-40}$ hydrocarbyl alcohols may be natural or synthetic, and linear or branched, with substantially linear alcohols being preferred, and may be primary, secondary or tertiary with primary alcohols being preferred. Suitable alcohols include natural alcohols, e.g., decyl ($C_{10}$), lauryl ($C_{12}$), myristyl ($C_{14}$), palmityl ($C_{16}$), stearyl ($C_{18}$), arachidyl ($C_{20}$), behenyl ($C_{22}$), lignoceryl ($C_{24}$), or cerotyl ($C_{26}$) alcohols or mixtures thereof, and synthetic alcohols, e.g., hydroformylation alcohols, such as mixtures of $C_{12-13}$ or $C_{12-15}$ or $C_{18-22}$ hydroformylation alcohols, or alcohols derived from Ziegler type catalysts and olefins (e.g., "Alfol" or "EPAL" alcohols). A most preferred mixture is a mixture of $C_{18-22}$ alcohols having an average carbon number of about 21.

Most preferred filterability improvers are alkyl malic acid diesters, such as di-$C_{15-25}$ or di-$C_{15-30}$ alkyl malic acid diesters.

The direct esterification of one or more of the aforesaid hydroxy-carboxylic acids with one or more suitable hydrocarbyl alcohols may be carried out by conventional techniques. The amount of alcohol used may be such to obtain a mono-or, in the case of polycarboxylic acids, a polyester. An excess of alcohol may be used. In the case of polycarboxylic acids, the acid may partially decarboxylate during the esterification process so that the fully esterified product contains one less ester group than would be expected on theoretical grounds. The hydroxy-carboxylic acids may also form small amounts of selfesterification polymers during the esterification process. The esterification process may be carried out at elevated temperatures and/or in the presence of an acidic catalyst. The esterified products may be worked up by known techniques e.g. by washing with water.

The filterability improvers should be soluble in the middle distillate fuel, which means that they are capable of dissolving to the desired extent in the middle distillate fuel. The concentration of the filterability improver in the middle distillate fuel may vary between wide limits, with from 15 to 2500 ppm being usual and with from 50 to 800 ppm being preferred.

The products may contain small amounts of unreacted alcohols or of fully or partially unconverted acids.

The composition of the present invention may contain a pourpoint depressant. Suitable pour-point depressants include copolymers of ethylene and vinyl esters (e.g. ethylene/vinyl acetate copolymers), alkylacrylates, alkylmethacrylates or alkylfumarates; chlorinated polyethylene; alkylated aromatics; alkylated polystyrene; fully or partially hydrogenated polymers or copolymers of olefins, such as butadiene or mixtures of butadiene and styrene; polyalkylacrylates or methacrylates and mixtures thereof.

It is preferred that the pour-point depressant is a polyalkylacrylate or methacrylate and it has been surprisingly discovered in some distillate fuels these pour-point depressants and the filterability improvers, as herein defined, are synergistic. However, any type of pour-point depressant would form useful combinations with the filterability improvers. Particularly suitable polyalkylacrylates or methacrylates are those having molecular weights in the range of from 2,000 to 500,000, wherein the alkyl groups are $C_{1-30}$ alkyl groups, such as $C_{6-26}$ groups. Particularly preferred are those having an average number of carbon atoms in the alkyl groups of from 10 to 17.

Hydrogenated styrene-butadiene copolymers suitable as pourpoint depressants are those having an average molecular weight of from 2,500 to 1,000,000, a styrene content of from 5 to 50% and a butadiene content of from 50 to 95%.

The concentration of pour-point depressant in the middle distillate fuel may vary between wide limits, with from 1 to 2,500 ppm being usual and with from 15 to 800 ppm being preferred. The weight ratio of pour-point depressant to filterability improver may also vary between wide limits, e.g. from 99:1 to 1:99, but is preferably within the range of from 75:25 to 25:75, with a 50:50 ratio being very suitable.

The additives may be added to the middle distillate fuel by various methods, but it is convenient to form a solution, dispersion or emulsion of the additives in a suitable solvent, e.g. toluene, benzene or a small amount of middle distillate fuel which is then added as a concentrate to the middle distillate fuel.

The invention will now be illustrated with reference to the following examples.

In the examples the pour-point of the middle distillate fuel or middle distillate fuel composition was determined by a standardized laboratory test comprising placing the test material in a test-tube which is then cooled until the test-tube can be held horizontally for 5 seconds without its content (a crystalline waxy mass) beginning to flow. This temperature is called the setting-point of the test material. During the cooling of the test-tube it is lifted out of the cooling bath every temperature decrease of 3° C. The temperature reading immediately before the setting-point is reached is the lowest temperature observed at which the waxy mixture flows. This temperature is called the pour-point of the test material.

In the examples, the filterability of the middle distillate fuel or middle distillate fuel composition was determined by the cold filter plugging point test (CFPP) according to DIN 51428.

In this test 45 cc of test material is cooled and after every 1° C of cooling 20 ml is filtered through a 350 mesh filter at 20 cm $H_2O$ pressure difference. If this 20 ml of test material is unable to pass through the filter within one minute it is considered to have failed the test at the temperature. For example, a CFPP result of −10° C means that the sample is unable to pass through the filter within one minute at temperatures below −9° C.

Middle distillate fuel compositions were prepared by adding toluene solutions of additives, as specified below, to the middle distillate fuels described in Table I.

Table I

| Middle Distillate Fuel | 1 | 2 | 3 | 4 | 5 | 6 |
|---|---|---|---|---|---|---|
| Pour Point (° C) | (−)12 | (−)15 | (−)15 | (−)9 | (−)15 | (−)12 |
| Cloud Point (° C) | (−)12 | (−)11 | (−)12 | (−)6 | (−)6 | (−)3 |
| CFPP (° C) | (−)12 | (−)12 | (−)12 | (−)7 | (−)7 | (−)7 |
| Aniline Point (° C) | | | | 69.2 | 68.3 | 67.6 |
| 10% Boiling Point (° C) | 221 | 227 | 222 | 236 | 204 | 200 |
| 90% Boiling Point (° C) | 318 | 310 | 315 | 329 | 334 | 339 |

Table I-continued

| Middle Distillate Fuel | 1 | 2 | 3 | 4 | 5 | 6 |
|---|---|---|---|---|---|---|
| Wax Content (%w) | 1 | 1 | 1 | ca 2.5 | ca 2.5 | ca 2.5 |

The pour-point depressants used in the Examples were polymers having the following properties:

Pour-point depressant A: Polyalkylmethacrylate polymer of average number molecular weight 100,000; number of carbon atoms in alkyl groups ranging from 9 to 18.

Pour-point depressant B: A polyalkylmethacrylate polymer of average number molecular weight 30,000; number of carbon atoms in alkyl groups ranging from 6 to 20.

Pour-point depressant C: A polyalkylmethacrylate polymer of average number molecular weight of 50,000; number of carbon atoms in the alkyl groups ranging from 9 to 18.

Pour-point depressant D; A hydrogenated styrene-butadiene copolymer pour-point depressant (GPC peak molecular weight on polystyrene scale 96,000; styrene content 27 %w; butadiene content 63 %w).

EXAMPLE I

Filterability improver (A) was prepared by melting a mixture of 13.4 g of malic acid and 62.4 g of a mixture of natural $C_{18}$ to $C_{22}$ alcohols having an average molecular weight of 312 (average $C_{21}$). The melt was stirred for 4.75 hours at 180° C while purging with nitrogen. The product was then cooled to give a 95% yield of the filterability improver having an acid content of 0.14 mg.eq/g, an unconverted alcohol content of 9 %w and a melting range of 61.1° to 62.3° C.

EXAMPLE II

Filterability improver (B) was prepared by melting 272.8 g of a mixture of synthetic $C_{10}$ to $C_{26}$ substantially straight-chain primary alcohols ("Alfol" alcohols) having an average molecular weight of 341 (average $C_{23}$), and adding 53.6 g of malic acid to the melt. The melt was stirred for 4.5 hours at 140° C while purging with nitrogen. The product was then cooled to give a 97% yield of the filterability improver having an acid content of 0.21 mg.eq/g, an unconverted alcohol content of 10 %w and a melting range similar to the product Example I.

EXAMPLE III

Filterability improver (C) was prepared by melting a mixture of 26.8 g of malic acid and 124.8 g of a mixture of $C_{18}$, $C_{20}$ and $C_{22}$ hydroformylation alcohols (average $C_{21}$) and stirring the melt for 4.5 hours at 180° C, while bubbling nitrogen therethrough. The product was then cooled to give a 95% yield of the diester having a melting range of 61.1° to 62.3° C.

EXAMPLE IV

Filterability improver (D) was prepared by refluxing a solution of 28.6 g of malic acid. 124.8 g of a $C_{22}$ hydroformylation alcohol and 2 g of para-toluenesulphonic acid in 160 g of toluene in a Dean and Stark apparatus. The solution was refluxed for 5 hours after which it was cooled. 8 g of solid calcium hydroxide was then added to the solution to neutralize the para-toluenesulphonic acid. The mixture was stirred for 15 minutes and filtered. The remaining solution was washed with $H_2O$ and dried with sodium sulphate. The toluene was then evaporated from the solution to give a 85% yield of the diester having a melting range of 63.8° to 64.4° C.

EXAMPLES V–XVI

These examples illustrate fuel compositions in which the addition of filterability improver without pour-point depressant (PPD) was effective in providing the desired improvement in filterability.

The type of fuel, type and amount of additive used in parts per million (ppm) by weight of fuel, and the CFPPs of the compositions are given in Table II.

Table II

| | | Filterability Improver | | |
|---|---|---|---|---|
| Example | Fuel Type | Type | Amount (ppm) | CFPP ° C |
| V | 1 | A | 38 | (−)18 |
| VI | 1 | A | 150 | (−)19 |
| VII | 2 | A | 38 | (−)20 |
| VIII | 2 | A | 150 | (−)21 |
| IX | 3 | A | 38 | (−)21 |
| X | 3 | A | 75 | (−)24 |
| XI | 1 | B | 38 | (−)18 |
| XII | 1 | B | 75 | (−)19 |
| XIII | 2 | B | 38 | (−)20 |
| XIV | 2 | B | 75 | (−)21 |
| XV | 3 | B | 38 | (−)20 |
| XVI | 3 | B | 75 | (−)21 |

EXAMPLES XVII–XXIII

These examples illustrate fuel compositions in which the filterability of the fuel is significantly and synergistically improved by the presence of a pour-point depressant. In each case the compositions according to the invention is designated by a Roman numeral, and control compositions containing only one of the additives or no additive by an additional letter, as in "XVII *a*".

The type of fuel, type and amount of each additive used in ppm by weight of fuel, and the pour points and CFPPs of the compositions are given in Table III.

Table III

| | | Pour-point Depressant | | Filterability Improver | | | |
|---|---|---|---|---|---|---|---|
| Composition | Fuel Type | Type | Amount (ppm) | Type | Amount (ppm) | Pour-point ° C | CFPP ° C |
| Fuel | 4 | — | — | — | — | (−)9 | (−)7 |
| XVIII | 4 | A | 150 | C | 150 | (−)18 | (−)16 |
| XVIII a | 4 | A | 150 | — | — | (−)12 | (−)8 |
| XVIII b | 4 | A | 300 | — | — | (−)18 | (−)8 |
| XVIII c | 4 | — | — | C | 300 | (−)9 | (−)12 |
| XIX | 4 | B | 150 | C | 150 | (−)21 | (−)13 |
| XIX a | 4 | B | 150 | — | — | (−)12 | (−)8 |
| XIX b | 4 | B | 300 | — | — | (−)15 | (−)9 |

Table III-continued

| Composition | Fuel Type | Pour-point Depressant Type | Pour-point Depressant Amount (ppm) | Filterability Improver Type | Filterability Improver Amount (ppm) | Pour-point °C | CFPP °C |
|---|---|---|---|---|---|---|---|
| Fuel | 5 | — | — | — | — | (−)15 | (−)7 |
| XX | 5 | A | 150 | C | 150 | (−)30 | (−)22 |
| XX a | 5 | A | 150 | — | — | (−)21 | (−)8 |
| XX b | 5 | A | 300 | — | — | (−)21 | (−)9 |
| XX c | 5 | — | — | C | 300 | (−)15 | (−)17 |
| XXI | 5 | B | 150 | C | 150 | (−)24 | (−)18 |
| XXI a | 5 | B | 150 | — | — | (−)21 | (−)12 |
| XXI b | 5 | B | 300 | — | — | (−)21 | (−)12 |
| Fuel | 6 | — | — | — | — | (−)12 | (−)7 |
| XXII | 6 | B | 150 | C | 150 | (−)27 | (−)18 |
| XXII a | 6 | B | 150 | — | — | (−)27 | (−)11 |
| XXII b | 6 | B | 300 | — | — | (−)27 | (−)13 |
| XXII c | 6 | — | — | C | 300 | (−)12 | (−)11 |
| XXIII | 6 | C | 150 | D | 150 | (−)21 | (−)19 |
| XXIII a | 6 | C | 150 | — | — | (−)18 | (−)9 |
| XXIII b | 6 | C | 300 | — | — | (−)30 | (−)13 |
| XXIII c | 6 | — | — | D | 300 | (−)12 | (−)11 |

In the examples of Table III, the pour-point depressants were, of course, effective in reducing the pour-point when used without the filterability improver. In Examples XVIII-XXI, substituting half of the pour-point depressant with the filterability improver gave at least as effective a pour-point depressant effect and, in Examples XIX and XX a greatly improved pour-point decrease.

In all cases in fuels 4 or 5, the filterability improver used alone did not cause a useful decrease in CFPP, but it did result in a slight decrease in fuel 6. In all cases, however, the combination of pour-point depressant and filterability improver gave a great and useful decrease in CFPP.

EXAMPLES XXIV-XXXII

These examples illustrate the use of combined pour-point depressant and filterability improver in fuels 1-3, in which pour-point depressant is not required to accomplish a useful decrease in CFPP, as previously illustrated by Examples V-XVI.

The type of fuel, type and amount of additive used in ppm by weight of fuel, and the pour-points and CFPPs of the compositions are given in Table IV.

Table IV

| Composition | Fuel Type | Pour-point Depressant Type | Pour-point Depressant Amount (ppm) | Filterability Improver Type | Filterability Improver Amount (ppm) | Pour-point °C | CFPP °C |
|---|---|---|---|---|---|---|---|
| Fuel | 1 | — | — | — | — | (−)12 | (−)12 |
| XXIV | 1 | A | 150 | A | 150 | (−)21 | (−)17 |
| XXV | 1 | D | 100 | A | 200 | (−)18 | (−)16 |
| XXVI a | 1 | D | 300 | — | — | (−)21 | (−)13 |
| XXVI b | 1 | — | — | A | 150 | | (−)19 |
| Fuel | 2 | — | — | — | — | (−)15 | (−)12 |
| XXVII | 2 | A | 150 | A | 150 | (−)21 | (−)20 |
| XXVIII | 2 | D | 100 | A | 200 | (−)21 | (−)18 |
| XXIX a | 2 | D | 300 | — | — | (−)21 | (−)11 |
| XXIX b | 2 | — | — | A | 150 | | (−)21 |
| Fuel | 3 | — | — | — | — | (−)15 | (−)12 |
| XXX | 3 | A | 150 | A | 150 | (−)24 | (−)20 |
| XXXII | 3 | D | 300 | A | 200 | (−)21 | (−)19 |
| XXXII a | 3 | D | 300 | — | — | (−)21 | (−)13 |
| XXXII b | 3 | — | — | A | 75 | | (−)24 |

In the fuels illustrated in Table IV, filterability improver A, when used without pour-point depressant, was more effective in reducing the CFPP than when used in combination with the pour-point depressant. This contrasts with the results in the fuels of Table III, in which the same filterability improver required the addition of pour-point depressant in order to reduce CFPP significantly.

It has not been possible, so far, to determine criteria of the different fuels which unequivocally correlate with the need for pour-point depressant in order to provide the desired reduction in CFPP. However, it is extremely simple to test any given distillate fuel in order to determine whether the filterability improver is effective without pour-point depressant as in fuels in Table II, or requires the synergistic effect of a pour-point depressant, as in the fuels of Table III.

We claim as our invention

1. A middle distillate fuel composition of improved filterability, comprising a middle distillate fuel and, as filterability improver, from 50 to 800 parts per million, based on said fuel composition, of a $C_{10}$-$C_{40}$ hydrocarbyl ester of a hydroxy-alkyl carboxylic acid in which the $C_{10}$-$C_{40}$ hydrocarbyl group includes at least one uninterrupted chain of at least 8 methylene groups.

2. The composition of claim 1 wherein said filterability improver is a diester.

3. The composition of claim 2 wherein said filterability improver contains one hydroxyl group, which is on the alpha- or beta-carbon atom relative to the carbonyl carbon atom of an ester group.

4. The composition of claim 1 wherein the filterability improver is prepared by reacting a $C_{10}$–$C_{40}$ hydrocarbyl alcohol having at least one uninterrupted chain of at least 8 methylene groups, with a hydroxy-alkyl carboxylic acid.

5. The composition of claim 4 wherein the hydrocarbyl alcohol is a $C_{15}$ to $C_{25}$ alkanol.

6. The composition of claim 4 wherein the hydroxy-alkyl carboxylic acid is an alpha- or beta-hydroxy-dicarboxylic acid.

7. The composition of claim 4 wherein the hydroxy-alkyl carboxylic acid is malic acid.

8. The composition of claim 1 wherein the filterability improver is a di-$C_{15}$ to $C_{25}$ alkyl malic acid diester.

9. A middle distillate fuel composition of improved filterability comprising a middle distillate fuel and from 15 to 2500 parts per million of a combination of a pour-point depressant and a filterability improver, the ratio of the pour-point depressant to the filterability improver being in the range of from 75:25 to 25:75, and wherein said filterability improver is a $C_{10}$–$C_{40}$ hydrocarbyl ester of a hydroxycarboxylic acid in which the $C_{10}$–$C_{40}$ hydrocarbyl group includes at least one uninterrupted chain of at least 8 methylene groups.

10. The composition of claim 9 wherein said filterability improver is a diester.

11. The composition of claim 10 wherein said filterability improver contains one hydroxyl group, which is on the alpha- or beta-carbon atom relative to the carbonyl carbon atom of an ester group.

12. The composition of claim 9 wherein the filterability improver is prepared by reacting a $C_{10}$–$C_{40}$ hydrocarbyl alcohol having at least one uninterrupted chain of at least 8 methylene groups, with a hydroxy-alkyl carboxylic acid.

13. The composition of claim 12 wherein the hydrocarbyl alcohol is a $C_{15}$ to $C_{25}$ alkanol.

14. The composition of claim 12 wherein the hydroxy-alkyl carboxylic acid is an alpha- or beta-hydroxy-dicarboxylic acid.

15. The composition of claim 12 wherein the hydroxy-alkyl carboxylic acid is malic acid.

16. The composition of claim 9 wherein the filterability improver is a di-$C_{15}$ to $C_{25}$ alkyl malic acid diester.

17. The composition of claim 9 wherein the pour-point depressant is a polyalkylacrylate or methacrylate.

18. The composition of claim 9 wherein the pour-point depressant is a polyalkylacrylate or methacrylate having a molecular weight of from 2000 to 500,000, and wherein the alkyl groups are $C_1$–$C_{30}$ alkyl.

19. The composition of claim 18 wherein the filterability improver is a di-$C_{15}$ to $C_{25}$ alkyl malic acid diester.

* * * * *